United States Patent [19]

Hernandez et al.

[11] 4,139,699

[45] Feb. 13, 1979

[54] WATER INSENSITIVE STARCH FIBERS AND A PROCESS FOR THE PRODUCTION THEREOF

[75] Inventors: Henry R. Hernandez, Somerville; Donald S. Greif, Bound Brook; Albert N. Barna, Plainfield, all of N.J.; Douglas S. Thornton, Himsdale, Mass.

[73] Assignee: National Starch and Chemical Corporation, Bridgewater, N.J.

[21] Appl. No.: 842,669

[22] Filed: Oct. 17, 1977

Related U.S. Application Data

[63] Continuation-in-part of Ser. No. 670,342, Mar. 25, 1976, abandoned.

[51] Int. Cl.[2] ..... C08B 31/00

[52] U.S. Cl. ..... 536/109; 106/210; 106/213; 264/186

[58] Field of Search ..... 264/186; 536/107, 109; 106/210, 213

[56] References Cited

U.S. PATENT DOCUMENTS

| | | | |
|---|---|---|---|
| 2,570,449 | 10/1951 | Horsak | 264/186 |
| 2,837,438 | 6/1958 | Sample | 264/186 |
| 2,902,336 | 9/1959 | Hiemstra et al. | 264/186 |
| 3,030,667 | 4/1962 | Kunz | 264/186 |
| 3,051,700 | 8/1962 | Elizer et al. | 264/186 |
| 3,067,152 | 12/1962 | Fukushima et al. | 264/186 |
| 3,116,351 | 12/1963 | Wohlrabe et al. | 264/186 |
| 3,336,429 | 8/1967 | Carevic | 264/186 |

FOREIGN PATENT DOCUMENTS

| | | | |
|---|---|---|---|
| 49-4017 | 1/1974 | Japan | 264/186 |
| 50-105766 | 8/1975 | Japan | 264/186 |

OTHER PUBLICATIONS

"Application of Amylose in Food" *Shokohin Kogyo*, pp. 33–38, 1971.

*Primary Examiner*—Jay H. Woo
*Attorney, Agent, or Firm*—James & Franklin

[57] ABSTRACT

Water-insensitive starch fibers having an amylopectin content of about 55 to 100% by weight are prepared by extruding a colloidal starch dispersion in thread-like form into a moving coagulating bath. Water-insoluble additives may be incorporated into the starch dispersion so as to produce a fiber containing the additive in encapsulated form.

16 Claims, No Drawings

WATER INSENSITIVE STARCH FIBERS AND A PROCESS FOR THE PRODUCTION THEREOF

BACKGROUND OF THE INVENTION

This invention relates to regenerated starch in fiber form. More particularly, the invention relates to water insensitive starch fibers prepared from modified or unmodified starches containing from about 55 to 100% by weight amylopectin, and to a process of making the same.

Starch is a polymer comprising a plurality of anhydroglucose units arranged in one of two structural forms: as a linear chain polymer called amylose or as a highly branched polymer called amylopectin. The properties of these two forms of starch differ and much of the difference may be traced to the affinity of the hydroxyl groups in one particular structural molecule for those in another. Thus, in linear chain polymers such as amylose, the straight chains can orient in parallel alignment so that a large number of the hydroxyl groups along one chain are in close proximity to those on adjacent chains. When this happens, the hydroxyl groups form associations through hydrogen bonds and the chains are bound together forming aggregates which are insoluble in water. In very dilute solutions, the aggregated chains of amylose will precipitate; in more concentrated solutions, a gel will form. This essentially crystalline process of alignment, association and precipitation or gelling is known as retrogradation. Because of the linearity of amylose and its marked tendency to form associated aggregates, this material is insoluble in water and forms strong, flexible films.

In contrast, the highly branched chains of the amylopectin molecules cannot align and associate so readily. Consequently, amylopectin tends to be soluble in water, forming solutions that will not gel under normal conditions. However, prolonged aging or special conditions such as freezing may effect retrogradation in some dispersions containing amylopectin.

Principally due to these differences in the solubility properties of the two structural starch forms, previous attempts to produce water-insensitive starch fibers or films have been directed to starches containing substantial quantities of amylose. Thus, U.S. Pats. Nos. 2,902,336, 3,030,667, 3,336,429, and 3,116,351 among others, although differing in techniques for producing fibers, all have in common the use of starches containing at least 50%, and generally 80 to 100%, by weight amylose. The methods of these patents therefore rely on the linear chain amylose portion of the starch to provide the water-insensitive properties of the final fiber and any amylopectin present is treated as an impurity, tolerable in only minor quantities. However, it is well known in the art that such grades of starch containing 80 to 100% amylose do not occur naturally and are only obtained by subjecting starch to treatments wherein a substantial portion (i.e. that portion comprising amylopectin) is discarded, thereby rendering the manufacture and use of such fibers on a commercial scale economically disadvantageous.

Other methods for the preparation of starch containing fibers such as by plasticizing starch dispersions with softeners or fluxes to convert them into "pseudothermoplastics" or by thermally decomposing the starch to form a starch xanthate fiber have been taught in U.S. Pats. Nos. 2,570,449 and 3,497,584 respectively. Such methods require complicated processing conditions and some do not necessarily result in the production of water-insensitive fibers.

It is therefore an object of the present invention to provide a process for the production of water-insensitive starch fibers in which the presence of amylopectin is not deleterious.

It is another object to provide a process which produces starch fibers from starches which do not contain relatively high concentration of the linear chain polymer, amylose.

It is also an object to provide a process which produces starch fibers from naturally occurring starches, and hence is economical and efficient.

Another object is to provide such a process which produces starch fibers from 100% amylopectin.

Another object is to provide a process which produces starch fibers which are strong and durable as well as water-insensitive.

A further object is to provide a process whereby a variety of water-insoluble materials may be incorporated into a starch dispersion and subsequently encapsulated within the fiber matrix during its formation for the purpose of imparting a wide variety of functional characteristics to the final fiber.

Yet another object is to provide starch fibers which possess superior properties and which may be produced in discrete lengths and used as supplements to or replacements for natural cellulose fibers in a papermaking process.

These and other related objects will be apparent from the descriptions which follow.

SUMMARY OF THE INVENTION

In accordance with the present invention, water-insensitive starch fibers having an amylopectin content from about 55 to 100% by weight are prepared by extruding a thread-like stream of a collodial dispersion of the starch at 5 to 40% by weight solids into a moving coagulating bath. The coagulating bath employed comprises an aqueous solution containing at least one coagulating salt, such as ammonium sulfate, ammonium sulfamate, mono-basic ammonium phosphate, di-basic ammonium phosphate or mixtures thereof, the solution containing such coagulating salts in an amount at least sufficient to coagulate the starch. Fibers may be produced in desired lengths and widths by varying any of a number of process parameters as will be discussed in detail herein below.

Contrary to what would be expected based on the high amylopectin content of the starch employed, the starch fibers produced in accordance with the present invention are surprisingly water-insensitive and may be used in a variety of aqueous systems without losing their integrity. By the term "water-insensitive fiber" as used herein is meant that the resultant fibers are of sufficient integrity to allow for complete separation of the fiber from the aqueous slurry and recovery thereof. Additionally, the fibers will retain their integrity in aqueous slurries or dispersions under pH condition of 4.0 to 9.5 even after removal of the coagulating salt, and even at temperature as high as 40 to 72° C., depending upon the base starch. Moreover, these discontinuous filaments possess sufficient durability and shear-insensitivity such that they can be recovered in dry form or transported as an aqueous slurry or wet-slab and subsequently incorporated into conventional papermaking processes eiter alone or in combination with a variety of natural and/or synthetic staple fibers to produce paper-like sheets or webs as well as textiles, molded products, and other related applications.

DETAILED DESCRIPTION OF THE PREFERRED EMBODIMENTS

The starch employed in the present invention may be any starch containing from about 55 to 100% by weight amylopectin. For reasons of economy and availability, naturally occurring starches containing from about 64 to 100% amylopectin are preferred. In particular, corn starch (64–80% amylopectin) is employed; although waxy maize (93–100% amylopectin), rice (83–84% amylopectin), potato (about 78% amylopectin), tapioca (about 83% amylopectin), wheat (73–83% amylopectin), etc. may also be used. Mixtures of the starch bases may also be utilized as may mixtures of the fractionated components resulting in a total level of at least about 55% amylopectin.

The concentration of the starch solids in the dispersion will preferably be about 5 to 40% by weight. While higher concentrations of starch solids may be used, the resulting dispersions become very viscous and special equipment is required to handle them.

The particular starch employed must be used in the form of a collodial dispersion. For the purposes of this invention, the term "colloidal dispersion" means a dispersion of starch which is substantially free of granules and which exhibits, on standing at the temperature at which it is to be used, little evidence of gelation or precipitation. This state of dispersion may be obtained using a variety of techniques depending upon the particular starch base employed, the desired end use and the equipment available.

When native starches that are very high in amylopectin content, such as waxy maize, are employed, a suitable colloidal dispersion may be prepared merely by thoroughly cooking the starch in water with no chemical additives or modifications required. In most cases where starches which contain less than about 95% amylopectin are employed, it will be desirable to chemically derivatize or modify the starch to ensure its colloidal dispersion before adding it to the aqueous system. The derivatization or modification is carried out to an extent which will insure the production of the desired colloidal dispersion without affecting the ability of the starch to subsequently precipitate. Alternatively, if there is no objection to the presence of caustic in the system, the latter starches may be dispersed in aqueous sodium hydroxide, potassium hydroxide or other common alkali. As further alternatives, the starch bases may also be dispersed in a minor amount of an organic solvent such as dimethlysulfoxide and then added to water, or the starch base may be dispersed in conjunction with chemical additives such as urea and/or paraformaldehyde. In the cases where causticizing is employed, the amount of alkali used must be sufficient to adequately disperse the starch. Typical amounts of alkali used when sodium hydroxide is employed are from 15 to 40%, by weight, based on the weight of the starch.

In preparing the starch dispersion, the starch is added to the dispersing medium and vigorously agitated until a state of colloidal dispersion is achieved. In the case of dilute dispersions of starch (i.e. about 5–10% starch solids by weight), this will require about 45 minutes, with longer periods and/or moderate heat required for more concentrated starch dispersions or for certain chemically modified starch bases.

Most of the starch dispersions, including those prepared by cooking waxy maize and most of the chemically modified starches, may be cooled to room temperature prior to introduction into the coagulating bath. In the case of a few of the less chemically modified starches, it will be preferred to employ the dispersions at approximately the elevated temperatures at which they are prepared so as to maintain the colloidal dispersion and to insure efficient fiber production.

The coagulating bath used in preparing the starch fibers according to the present invention comprises an aqueous solution containing specific ammonium salts selected from the group consisting of ammonium sulfate, ammonium sulfamate, mono- and di-basic ammonium phosphate and mixtures thereof. It is also possible to combine the above-mentioned functional salts with other compatible salts which will form a starch precipitate so as to obtain satisfactory coagulation and a fibrous product. Suitable salts for this purpose include ammonium persulfate, ammonium carbonate, ammonium bromide, ammonium bisulfite, ammonium nitrite, ammonium nitrate, ammonium bicarbonate, ammonium oxalate, sodium and potassium chloride, sodium and potassium sulfate, among others. Generally no advantage is seen in using these additional salts since the ammonium sulfate, sulfamate or phosphate salts must still be present in their respective minimum amount in order to effect coagulation. The only instances where the presence of substantial amounts of other salts may be desirable is in the use of the recycled coagulation bath wherein salts are present which have been generated in situ, as will be discussed hereinbelow.

minimum concentration of the salt required to effect coagulation as well as the preferred salt or salt blend will vary depending upon the particular starch base employed. For example, in the case of waxy maize starch, it is necessary for ammonium sulfate to be present in amounts of at least 35%, by weight of the total solution, ammonium sulfamate 72% (saturation), dibasic ammonium phosphate 37% and mono-basic ammonium phosphate 40%. In the case of corn starch or similar starches containing about 64–80% amylopectin, lower concentrations of salt may be used with ammonium sulfate required in amounts of 20%, ammonium sulfamate 50%, mono-basic ammonium phosphate 25% and di-basic ammonium phosphate 30%.

It will be recognized that alkali salts are generated in the coagulating bath when causticized starch dispersions are employed, with satisfactory production of the desired starch fibers continuing until the level of the generated salt is relatively high. The generated salt tolerance level above which production of the fibers becomes inefficient will vary depending upon such factors as the specific salt employed, the total salt solids employed, the starch solid concentration in the dispersion, the amount of amylopectin in the starch base, etc. Once this salt tolerance level is determined, a steady-state system may be achieved at this maximum level (or less) by the periodic addition of ammonium sulfate on a continuous basis. As an example, when sodium hydroxide is used as a dispersing medium and the starch mixture is extruded into an ammonium sulfate coagulating bath, sodium sulfate is generated. In this case, it has been found that production of corn starch fibers (13% solids dispersion) will continue at a satisfactory level until a maximum of about 70 parts sodium sulfate per 30 parts ammonium sulfate (44% solids solution) is present in the bath. Above this level of sodium sulfate, production of the starch fibers becomes less efficient and the resulting fibers tend to lose their individual integrity. However, by adding a small amount of an inorganic acid to the initial coagulating bath or to the bath during formation of the fibers, the level of the generated salt in the system may be appreciably raised before production of the fibers is seriously affected. Thus, using the example described previously, the addition of as little as 3 parts of sulfuric acid per hundred parts of the initially charged coagulating bath salt results in a tolerance level of 90 parts sodium sulfate per 10 parts ammonium sulfate thereby increasing the longevity of the coagulating bath.

It is apparent that the salt solution used in the fiber forming process may be recycled and used again once the fibers have been removed. In this regard, the starch dispersions which do not contain caustic present little difficulty in recycling other than that the solids concentration of the salt be maintained. However, in those cases where causticized starch dispersions are employed, chemical reactions with the coagulating solution will occur. For example, if ammonium sulfate is used, the reaction results in the formation of ammonium gas and sodium sulfate. The recycling of such a system can be extended by recovering the ammonia in an acid scrubber and returning it to the system as ammonium sulfate. The generated sodium sulfate can be used in the coagulating bath as part of the salt blend until the tolerance levels discussed previously are attained or can be used as a raw material in pulp or papermaking operations e.g. as "salt cake" in the production of Kraft pulp.

Starch fibers can be produced at any temperature at which the starch dispersion can be handled. Generally, the coagulation bath is maintained at about room temperature (20° C), however, temperatures as high as about 70° C. may be used. These higher temperatures may be desired under certain conditions since they increase the solubility of the salt in the coagulating bath resulting in more concentrated solutions. Thus, when it is desired to produce waxy maize fibers using mono-basic ammonium phosphate as coagulant, it is desirable to increase the temperature of the bath so as to obtain a concentration of salt of approximately 40% (saturation level for the mono-basic ammonium phosphate at 20° C. is 28%).

In preparing the starch fibers of the invention, the starch dispersion is introduced continuously or by drops in the form of a thread-like stream into the moving coagulating salt solution. This introduction may be accomplished from either above or below the salt solution using any conventional techniques. Thus, the dispersion may be extruded through an apparatus containing at least one aperture, such as a spinnerette, a syringe or a biuret feed tube. Alternatively, the dispersion may be discharged under pressure from a pipe or tube containing a plurality of apertures into a surrounding enclosed area, e.g. a concentric pipe, containing the moving coagulating solution. Various adaptions of the above and related techniques may be used and the fibers may be thus produced using either batch or continuous operations.

In accordance with either embodiment, the aqueous salt coagulating solution should be moving when the starch dispersion is introduced and the directionality of the two flows can also be utilized in controlling fiber lengths and diameters or widths. Thus, if the salt solution is moving in a direction generally concurrent with the flow of the starch dispersion, relatively round fiber lengths are formed; if the starch dispersion is introduced at an angle of about 90° to the flow of the salt solution, relatively flatter fibers are formed. Generally apertures of 10 to 500 microns in diameter are preferred, particularly when the fibers are to be used in papermaking operations.

It is also possible to control the length and width of the fibers by varying the relative flow velocities of the two liquid components. As an example, if the starch dispersion is extruded through an aperture of 337 microns and the ratio of the velocity of the salt solution to the velocity of the starch dispersion is 0.92, fiber diameters of 610 microns may be produced. Increasing the velocity ratio to 2.985 (maintaining all other parameter control) can result in fiber diameters averaging about 113 microns. Similar relationships have been found with respect to the length of the fibers and fibers varying in length from 0.05 mm. to 16 cm. have been produced. When the starch fibers are produced for subsequent use in papermaking operations, it is generally desirable to obtain fibers in lengths of from about 0.1 to 3.0 mm. and widths of 10 to 500 microns.

It will be recognized that the length, cross-sectional size and configuration of the resultant fibers are dependent upon a number of interrelated parameters in addition to those described hereinabove. Thus, the viscosity, the solids content of the starch dispersion, as well as the particular components used in the coagulating solution and/or stach dispersion are additional factors which can be used in conjunction with the parameters discussed previously in order to control the dimensions of the resultant fiber.

Depending upon the desired end use of the fibers, the method of recovery thereof may vary. Thus, the aqueous suspension or slurry of fibers may be used directly, such as by introducing it into the pulp stream, thereby enabling complete integration of the fiber production into the paper manufacturing plant. The fibers may also be recovered in the dry state, for example, by collecting the fibers from water on a screen or similar device. It is then preferable to reslurry the fibers into a non-aqueous solvent such as methanol, ethanol, isopropanol, acetone or the like in which the fibers are not soluble. The fibers are then recovered, as by filtration, from the solvent and dried. Other methods such as centrifuging, flash-drying or spray-drying may also be used to remove the water. Once dried, the fibers may be re-introduced into an aqueous medium and will exhibit excellent re-dispersibility maintaining their discrete, discontinuous structure. Alternatively, the fibers may be recovered from the slurry, as by filtration, washed and placed in water at levels of up to about 50% solids and formed into "wet slabs" for subsequent use.

As a further embodiment of the present invention, the starch employed may be chemically treated to vary the properties of the fiber produced or to help effect formation of the colloidal dispersion. Alternatively, the starch fibers may be treated after formation in order to produce certain functional characteristics. Thus, the starch may be chemically treated, as by aminoethylation, in order to provide rapid dispersibility of the starch in the dispersion, which treatment will also result in the production of a fiber which possesses a cationic charge when employed in an aqueous medium. Similarly, a starch may be used which is modified to contain anionic groups so as to be stable in a dispersion and which will produce a fiber having anionic properties. The fibers may also be modified after their formation in order to achieve specific functional properties. Thus, improved anionic functionality might be obtained by bleaching the fibers after precipitation as long as the conditions are not so severe as to destroy the fibers. The properties of the fibers may also be controlled by using blends of modified and unmodified starches or by the addition of other functional materials, such as polyacrylic acid, to obtain the specifically desired properties.

It is also possible to incorporate in the dispersing medium certain hydrocolloids and to extrude the hydrocolloid together with the starch in order to produce a starch-hydrocolloid fiber. In order to achieve this combination fiber, it is only necessary that the hydrocolloid (in minor amounts, i.e. less than 50% by total solids weight), together with the starch, be placed in a state of colloidal dispersion prior to contact with the coagulating bath. Thus, in the case of water-dispersible hydrocolloids such as polyvinyl alcohol, carboxymethylcellulose, hydroxyethylcellulose, etc., it is only necessary to add the hydrocolloid to the water in which the starch is dispersed. In the case of other hydrocolloids, such as casein, it will be necessary to causticize the dispersion in order to form the colloidal dispersion required.

As an alternative embodiment of the present invention, water-insoluble additives may be uniformly admixed throughout the starch dispersion and subsequently encapsulated within the resultant starch fiber. Thus, water-insoluble additives including pigments, metallic powders, latices, oils, plasticizers, microspheres (glass beads, foamed silica or other low density materials either in blown or unblown form), etc., may be encapsulated within the starch fibers of the invention. In a similar manner, water-insoluble synthetic polymers or latices, such as polyvinyl acetate, polyacrylonitrile, polystyrene, etc., may be incorporated within the fiber. It will also be noted that the density of the starch fibers may be varied by incorporating air or other gases in the starch dispersion prior to passing it into the coagulating bath.

It is further noted that certain water-soluble solid additives may also be co-extended with the starch fibers. In such cases, the additive will be dissolved in the aqueous starch dispersion and the coagulating bath which is employed in forming the starch fibers will be adjusted by the addition of a sufficient quantity of a compatible salt capable of precipitating the additive. As an example, a commercial rosin size can be added to the starch dispersion and extruded into a coagulating bath containing the functional starch-coagulating salt together with sufficient aluminum sulfate to precipitate the rosin thereby forming a co-precipitated starch-aluminum rosinate fiber.

The water-insolubility of the starch fibers of the present invention can be further enhanced by the incorporation of conventional cross-linking agents, such as urea-formaldehyde, glyoxal, urea-melamine-formaldehyde, Kymene (registered tradename of Hercules Inc., Wilmington, Delaware), etc. These cross-linking agents may be incorporated into the starch dispersion prior to extrusion or may be post-added to the starch fiber.

In all the above described embodiments, the amount of additive to be incorporated into the starch dispersion will vary over a wide range depending upon the specific additive and the desired end use. Thus, amounts of additive as little as about 0.01% to as high as about 80% may be employed and incorporated into the starch fibers.

The resultant discontinues starch fibers possess sufficient integrity, durability and shear insensitivity that they may be readily utilized in a variety of applications including textiles, molded products, etc., as well as in the papermaking operation described in our co-pending application Ser. No. 670,360 filed Mar. 25, 1976 now abandoned.

The starch fibers of this invention and the process for making the same are illustrated further by the following examples which are not, however, intended to limit the scope of the invention. Unless otherwise stated, all parts in the examples are by weight.

EXAMPLE 1

A slurry was prepared using an unmodified waxy maize starch containing essentially 100% amylopectin in water at a 15% solids level. The slurry was then placed on a boiling water bath and cooked at 96° C. with mechanical agitation for a period of 30 minutes. After cooking, the resulting starch dispersion was cooled to 22° C., and its viscosity, measured with a RVF Brookfield Viscometer, was found to be 5000 cps. at 20 RPM.

The starch dispersion was then extruded at 703.08 gms./cm.$^2$ pressure from a stainless steel spinnerette containing 100 apertures, each of which had a diameter of 204.2 microns. The dispersion was extruded at an angle of approximately 90° into an agitated aqueous coagulating bath consisting of a 44% by weight aqueous solution of ammonium sulfate maintained at room temperature. The extrusion process was continued for a period of 30 minutes and the resultant discontinuous fibers were agitated in the salt solution for an additional hour.

Thereafter the fibers were recovered from the salt solution by collecting them on a 100 mesh stainless steel screen and washed free of salt with water. The fibers at this point may be introduced directly into a papermaking process or consolidated into wet mat form at approximately 50% solids.

Alternatively, the fibers may be reclaimed in dry form after recovery from the salt solution by introducing them into a solution of ethyl alcohol and mixing for a period of 10 minutes.

The fibers may then be recovered from the alcohol solution by using screen filtration techniques and either air or oven dried.

The discontinuous fibrous products formed by the previously described techniques were found to possess a cross-sectional diameter averaging approximately 100 microns and a length distribution between 500 and 3000 microns. The procedure produced a satisfactory starch fiber product, i.e. the fibers were water-insensitive and, after drying, were readily redispersible in water while retaining their original structure and configuration.

EXAMPLES 2-22

These examples show the use of a variety of starch bases and dispersion methods in the process of the present invention.

The basic procedure described in Example 1 was duplicated using the materials, dispersing methods and parameters shown in Table I.

In all cases, the resultant fibers were water-insensitive and exhibited other satisfactory starch fiber properties.

EXAMPLES 23–26

These examples illustrate the effect of varying the angle of entry of the starch stream into the coagulating bath.

In the four examples which follow, a 10% solids dispersion of unmodified corn starch was prepared by dispersing in a 15% solids caustic solution. The resulting dispersion, having a viscosity of 2100 cps., was extruded under 2812.32 gm/cm$^2$ pressure through a spinnerette having apertures 204.2 microns in diameter. The basic procedure described in Example 1 was repeated using the parameters shown in Table II.

one of the following salts: sodium sulfate, ammonium bisulfite, ammonium persulfate, ammonium nitrite, ammonium carbonate, ammonium bicarbonate, ammonium bromide, ammonium oxalate, sodium chloride and potassium sulfate.

Satisfactory water-insensitive starch fibers were produced in all cases.

EXAMPLE 28

Using the basic procedure outlined in Example 1, a slurry was prepared from waxy maize starch at 15% solids which was heated to 96° C. until a state of colloidal dispersion was obtained.

TABLE I

| Ex. No. | Starch Base | Starch Solids | Dispersion Technique | Starch Viscosity at 22° C | Aperture Size (μ) | Angle of Entry | Salt Type | Salt % | Approximate Avg. Fiber Diameter (microns) | Pressure gms/cm$^2$ |
|---|---|---|---|---|---|---|---|---|---|---|
| 2 | Acid converted waxy maize | 38% | cook | 6020 cps | 204.2 | 90° | $(NH_4)_2SO_4$ | 44% | 100 | 1406.16 |
| 3 | Aminoethylated corn | 10% | cook | 10,000 | 204.2 | 90° | $(NH_4)_2SO_4$ | 44% | 75 | 1406.16 |
| 4 | Corn | 10% | 15% caustic | 2365 | 337.5 | 90° | $(NH_4)_2SO_4$ | 44% | 150 | 703.08 |
| 5 | Potato | 10% | 15% caustic | 875 | 102.1 | 90° | $(NH_4)_2SO_4$ | 44% | 75 | 703.08 |
| 6 | Tapioca | 7.5% | 15% caustic | 1500 | 102.1 | 90° | $(NH_4)_2SO_4$ | 44% | 100 | 703.08 |
| 7 | Aminoethylated potato | 10% | 15% caustic | 1500 | 102.1 | 90° | $(NH_4)_2SO_4$ | 44% | 100 | 703.08 |
| 8 | Amylon 5[1] | 13% | 40% caustic | 2620 | 337.5 | 45° | $(NH_4)_2SO_4$ | 44% | 450 | 2109.24 |
| 9 | Amylon 5 | 13% | 40% caustic | 2620 | 204.2 | 90° | $(NH_4)_2SO_4$ | 15% | 150 | 1054.62 |
| 10 | Amylon 5 | 15% | cooked in DMSO | 2000 | 204.2 | 45° | $(NH_4)_2SO_4$ | 44% | 150 | 1054.62 |
| 11 | Amylon 5 | 15% | Paraformaldehyde | 1025 | 204.2 | 45° | $(NH_4)_2SO_4$ | 44% | 125 | 1054.62 |
| 12 | Amylon 5 | 13% | 40% caustic | 2620 | 204.2 | 45° | 70 $(NH_4)_2SO_4$<br>30 $Na_2SO_4$ | 28% | 150 | 1054.62 |
| 13 | Amylon 5 | 13% | 40% caustic | 2620 | 204.2 | 45° | 90 $(NH_4)_2SO_4$<br>10 $H_2SO_4$ | 28% | 150 | 1054.62 |
| 14 | Corn | 10% | 15% caustic | 2365 | 204.2 | 90° | $(NH_4)_2HPO_4$ | Satd. | 100 | 703.08 |
| 15 | Waxy maize | 10% | cooked | 2050 | 204.2 | 90° | $(NH_4)_2HPO_4$ | Satd. | 90 | 703.08 |
| 16 | Corn | 10% | 15% caustic | 2365 | 204.2 | 90° | $NH_4NH_2SO_3$ | Satd. | 75 | 703.08 |
| 17 | Waxy maize | 10% | cooked | 2050 | 204.2 | 90° | $NH_4NH_2SO_3$ | Satd. | 90 | 703.08 |
| 18 | Amylon 5 | 13% | 40% caustic | 2620 | 102.1 | 45° | $(NH_4)H_2PO_4$ | Satd. | 75 | 703.08 |
| 19 | Corn | 13% | 15% caustic | 2365 | 100 | 90° | 90 $Na_2SO_4$<br>10 $(NH_4)_2SO_4$<br>3 $H_2SO_4$ | 44% | 75 | 703.08 |
| 20 | Starch blend containing 55% amylopectin[2] | 10% | 40% caustic | 2350 | 204.2 | 90° | $(NH_4)_2SO_4$ | 44% | 95 | 703.08 |
| 21 | Oxidized corn starch | 10% | cooked | 27 | 204.2 | 90° | $(NH_4)_2SO_4$ | 44% | 75 | 356.54 |
| 22 | Acid-converted sulfo-succinated corn starch | 5% | cooked | 9050 | 204.2 | 90° | $(NH_4)_2SO_4$ | 44% | 150 | 1406.16 |

[1]A hybrid corn starch containing approximately 52% amylose (available from National Starch and Chemical Corporation).
[2]Mixture of 58% corn starch and 42% of a hybrid starch containing 70% amylose so as to obtain a blended starch product containing 55% amylopectin.

TABLE II

| Example No. | Angle of Entry | Velocity ratio (salt/starch) | Avg. Fiber Diameter (microns) |
|---|---|---|---|
| 23 | 0° | —[3] | 138 |
| 24 | 45° | 8.9 | 73 |
| 25 | 90° | 6.99 | 85 |
| 26 | 180° | 0.15 | 565 |

[3]Meaningless due to inherent nature of countercurrent feed.

The resulting fibers varied in diameter (width) as shown in the table. The cross-sectional configuration also varied with the roundest fiber being formed at the 180° entry and the flattest at 90° entry.

EXAMPLE 27

Two starch dispersions were prepared at 10% solids: one from corn starch (using 15% caustic) and another from waxy maize starch using the methods described in Example 1–22. The dispersions were introduced into eight salt blend solutions prepared at 44% solids and consisting of 90 parts ammonium sulfate and 10 parts of A pigment dispersion was separately prepared with equal parts of $Sb_2O_3$ and dry vinyl chloride powder which were wetted in water using 1.5% pigment dispersant such that the total solids were 65%.

The pigment dispersion was then added to the previously prepared and cooled starch dispersion so that there were equal dry parts of each component and the final solids level was 24.4%, by weight.

The mixture was then introduced into an ammonium sulfate coagulating bath as described in Example 1 and a water-insensitive fiber containing encapsulated $Sb_2O_3$/vinyl chloride was produced.

EXAMPLES 29–41

Using the techniques shown in Example 1–22, starch fibers were prepared containing a variety of water-insoluble additives. The individual components and amounts are shown in Table III. In all cases, water-insensitive fibers having satisfactory properties for use in a number of applications were produced.

TABLE III

| Ex. No. | Starch | Additive | % Additive in Starch Fiber | Comments |
|---|---|---|---|---|
| 29 | Waxy maize | titanium dioxide | 22.7% | 0.2% (based on combined solids weight) tetrasodium pyrophosphate added as dispersant |
| 30 | Waxy maize | aluminum powder | 22.7% | — |
| 31 | Waxy maize | uncooked corn starch | 33.3% | — |
| 32 | Corn | pulverized clay | 80% | — |
| 33 | Corn | iron powder | 33.8% | — |
| 34 | Amylon 5 | blown microspheres | 10% | — |
| 35 | Amylon 5 | unblown microspheres | 25% | — |
| 36 | Waxy maize | calcium carbonate | 25% | — |
| 37 | Amylon 5 | rosin size | 5% | 5% $Al_2(SO_4)_3$ added to coagulating bath in order to precipitate the rosin |
| 38 | Waxy maize | alkenyl succinic anhydride | 5% | — |
| 39 | Amylon 5 | carbon black | 25% | Marasperse B (available from Marathon Chemical) was added as a dispersant |
| 40 | Waxy maize | barium carbonate | 25% | — |
| 41 | Amylon 5 | tres-dichloro-propyl phosphate | 57.1% | 0.5% Triton N-101 (a surfactant available from Rohm and Haas) was added as a dispersant. |

EXAMPLE 42

This example shows the use of hydrocolloids in conjunction with starch to form a starch/hydrocolloid fiber. The example also illustrates a method for the incorporation of air into the fiber so as to produce a low density fiber.

A dispersion of Amylon 5 was prepared by slurrying the starch in water and adding 40% caustic, on a dry weight basis of starch, with mechanical agitation.

A 4% solids dispersion of polyvinyl alcohol was prepared and heated for one hour at 82° C. with mechanical agitation. The starch and polyvinyl alcohol dispersions were combined with mixing such that the final mixture contained:

7.5 parts Amylon 5
2.5 parts polyvinyl alcohol
3.0 parts sodium hydroxide
87.0 parts water The mixture was then added to a Hobart Mixer (Hobart manufacturing Co., Kitchen Aid Model 4C) and agitated 15 minutes at high speed. A thick foam resulted containing approximately 60% air by volume. The mixture was extruded through an apparatus containing 100 apertures, each of which had a diameter of 204.2 microns, at an angle of 90° into a coagulating bath containing 28% solids ammonium sulfate. A water-insensitive fiber was obtained which contained air voids and possessed a lower density than water, and had a diameter of approximately 175 microns.

The preferred embodiments of the present invention having been described above, various modifications and improvements thereon will now become readily apparent to those skilled in the art. Accordingly, the spirit and scope of the present invention is defined not by the foregoing disclosure, but only by the appended claims.

We claim:

1. A process for the production of water-insensitive starch fibers comprising extruding a thread-like stream of a colloidal dispersion of a starch containing 55–100% by weight amylopectin at 5–40% by weight solids, into a moving coagulating bath comprising an aqueous solution of a coagulating salt selected from the group consisting of ammonium sulfate, ammonium sulfamate, monobasic ammonium phosphate, di-basic ammonium phosphate and mixtures thereof, said solution containing said coagulating salt in an amount at least sufficient to coagulate said starch.

2. The process of claim 1 wherein said starch is waxy maize, corn or tapioca.

3. The process of claim 1 wherein said starch is an ether or ester starch derivative.

4. The process of claim 1 wherein said starch is a cationically derivatized starch.

5. The process of claim 1 wherein said starch is waxy maize and said coagulating salt is ammonium sulfate present in an amount of at least 35% by weight of said solution.

6. The process of claim 1 including the additional step of periodically adding to said coagulating bath an inorganic acid.

7. The process of claim 1 wherein there is additionally present in the dispersing medium of said dispersion a hydrocolloid material replacing said starch in an amount of less than 50% by weight.

8. The process of claim 1 wherein there is additionally present in the dispersion medium of said dispersion at least one water-insoluble material.

9. The process of claim 1 wherein there is additionally present in the dispersing medium of said dispersion at least one water-soluble material and wherein there is additionally present in said coagulating bath at least one compatible salt capable of precipitating said water-soluble material.

10. The process of claim 1 wherein said starch dispersion is introduced into said coagulating bath through an apparatus having at least one aperture of 10 to 500 microns in diameter.

11. The process of claim 1 wherein said coagulation bath is maintained at a temperature of 20 to 70° C.

12. The process of claim 1 wherein said starch dispersion is introduced into said coagulating bath at an angle of approximately 90° thereto.

13. The process of claim 1 wherein said starch dispersion is introduced into said coagulating bath in a direction approximately concurrent thereto.

14. The starch fiber produced by the process of claim 1.

15. The starch fiber produced by the process of claim 7 and having a starch-hyrocolloid composition.

16. The starch fiber produced by the process of claim 8 and containing encapsulated therein the water-insoluble material.

* * * * *